US005207573A

United States Patent [19]

Miyagi et al.

[11] Patent Number: 5,207,573

[45] Date of Patent: May 4, 1993

[54] HEAT PROCESSING APPARATUS

[75] Inventors: Katsushin Miyagi; Tomio Kimishima, both of Sagamihara, Japan

[73] Assignee: Tokyo Electron Sagami Limited, Kanagawa, Japan

[21] Appl. No.: 824,094

[22] Filed: Jan. 22, 1992

[30] Foreign Application Priority Data

Feb. 19, 1991 [JP] Japan ..... 3-046043

[51] Int. Cl.[5] ..... F27B 9/04

[52] U.S. Cl. ..... 432/152; 432/241; 432/253; 432/205; 432/206

[58] Field of Search ..... 432/241, 242, 205, 206, 432/152, 253

[56] References Cited

U.S. PATENT DOCUMENTS

| | | | |
|---|---|---|---|
| 4,596,526 | 6/1986 | Soliman | 432/205 |
| 4,938,691 | 7/1990 | Ohkase et al. | 432/253 |
| 4,943,234 | 7/1990 | Sohlbrand | 432/253 |
| 5,131,842 | 7/1992 | Miyazaki et al. | 432/253 |

FOREIGN PATENT DOCUMENTS

| | | |
|---|---|---|
| 62-92635 | 6/1987 | Japan . |
| 1-122064 | 8/1989 | Japan . |

*Primary Examiner*—Henry C. Yuen

*Attorney, Agent, or Firm*—Oblon, Spivak, McClelland, Maier & Neustadt

[57] ABSTRACT

A heat processing apparatus comprises a heating furnace, a process tube located in the heating furnace and having an open bottom, a manifold connected to the open bottom of the process tube, a sealing member sandwiched between the process tube and the manifold to air-tightly seal the process tube, a fixing member for fixing the process tube to the manifold, a heat transmitting member made of metal and sandwiched between the fixing member and the process tube to radiate heat at that area of the process tube, which is opposed to the fixing member, to the fixing member by heat conduction, and a heat exchange conduit arranged in the fixing member and having a passage through which heat exchanging medium flows to cool the fixing member by heat exchange.

15 Claims, 4 Drawing Sheets

HEAT PROCESSING APPARATUS

BACKGROUND OF THE INVENTION

1. Field of the Invention

The present invention relates to a heat processing apparatus for heat-processing matters such as semiconductor wafers while keeping them uniformly heated.

2. Description of the Related Art

There are usually well-known the heat processing apparatuses intended to apply a predetermined heat process to matters such as semiconductor wafers while keeping them uniformly heated, to thereby form thin film or diffuse heat on each of the semiconductor wafers.

One of the heat processing apparatuses of this kind is disclosed by Japanese Utility Model Disclosure Hei 1 - 122064. In the case of this heat processing apparatus, a seal section for the process tube is located adjacent to the open bottom of the heating furnace and an O-ring made of elastic material is set at this seal section. A lower flange of the seal section holding the O-ring is water-cooled and the ring-shaped outward projection of the process tube which is contacted with the O-ring is covered by an upper water-cooled flange of the seal section. The O-ring is made of elastic material having a heat resistance of 200° C., and the heat of the O-ring is cooled by the upper and lower water-cooled flanges.

When the heating furnace is heated to a high temperature of 1000° C., however, the lower portion of the O-ring which is contacted with the lower water-cooled flange can be kept 50° C., for example, but the upper portion thereof is heated higher than 200° C. by light radiated from the heating furnace and passed through the quartz-made process tube because the heat conductivity of the O-ring is low.

The ring-shaped outward projection of the process tube which is contacted with the upper portion of the O-ring is covered by the upper water-cooled flange and a heat transmitting Teflon packing is sandwiched between the upper flange and the ring-shaped outward projection of the process tube. When the process tube is exhausted vacuum, however, a clearance is created between the Teflon packing and the upper flange to stop heat conduction. As the result, the upper portion of the O-ring is heated higher than 200° C. and thus heat-dissolved. The O-ring cannot achieve sufficient sealing effect accordingly. In order to protect the O-ring from heat, however, the O-ring seal section must be located sufficiently remote from the heating furnace. This makes the heat processing apparatus large in size.

In the case of another heat processing apparatus disclosed in Japanese Utility Model Disclosure Sho 62 - 92635, the projected portion of a water-cooled cap is attached to the inside of the process tube which is contacted with the O-ring so as to cover the O-ring by the cap.

The O-ring in this apparatus can be sufficiently water-cooled because the projected portion of the water-cooled cap is inserted into the process tube. However, process gas used to form film on each semiconductor wafer is also cooled by the projected portion of the water-cooled cap inserted inside the process tube.

When $SiH_2Cl_2$ and $NH_3$ gases are introduced into the process tube to form film on each semiconductor wafer according to the CVD, therefore, film, easy to peel off, adheres to the projected portion of the cap because the temperature of this cap projection is low. Or powder product (or antimony chloride) adheres to it when its temperature is lower than 120° C. As the adhering film becomes thick or every time the process tube is opened and closed, the film or product peels off the cap and floats in the process tube to adhere to the wafers. The wafers are thus contaminated to thereby reduce the productivity of wafers.

SUMMARY OF THE INVENTION

The object of the present invention is therefore to provide a heat processing apparatus capable of preventing a sealing member, which is located to seal the process tube, from being heated higher than a predetermined temperature and also preventing products, easy to peel off, from adhering to the inner wall of the process tube.

This object of the present invention can be achieved by a heat processing apparatus comprising a heating furnace, a process tube located in the heating furnace and having an open bottom, a manifold connected to the open bottom of the process tube, a sealing member sandwiched between the process tube and the manifold to air-tightly seal the process tube, a fixing means for fixing the process tube to the manifold, a heat transmitting means made of metal and sandwiched between the fixing means and the process tube to radiate heat at that area of the process tube, which is opposed to the fixing means, to the fixing means by heat conduction, and a heat exchange means arranged in the fixing means and having a passage through which heat exchanging medium flows to cool the fixing means by heat exchange.

According to a heat processing apparatus of the present invention, the heat transmitting means made of excellent heat conductive metal is located between the lower end portion of the process tube and the fixing means which fixes the lower end portion of the process tube to the manifold. Even when the process tube is exhausted vacuum, therefore, the lower end portion of the process tube and the fixing means can be closely contacted with each other through the heat transmitting means. The heat of the sealing member can be therefore transmitted to the fixing means by the heat transmitting means and discharged outside the system by heat exchanging medium flowing through the passage.

The sealing member can be thus prevented from being heated higher than a predetermined temperature and even when the temperature of the process tube is high, the sealing member can be prevented from becoming deteriorated to thereby achieve sufficient sealing effect.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description give above and the detailed description of the preferred embodiments given below, serve to explain the principles of the invention.

DETAILED DESCRIPTION OF THE PREFERRED EMBODIMENTS

Some embodiments of the present invention will be described with reference to the accompanying drawings.

Figure 1:
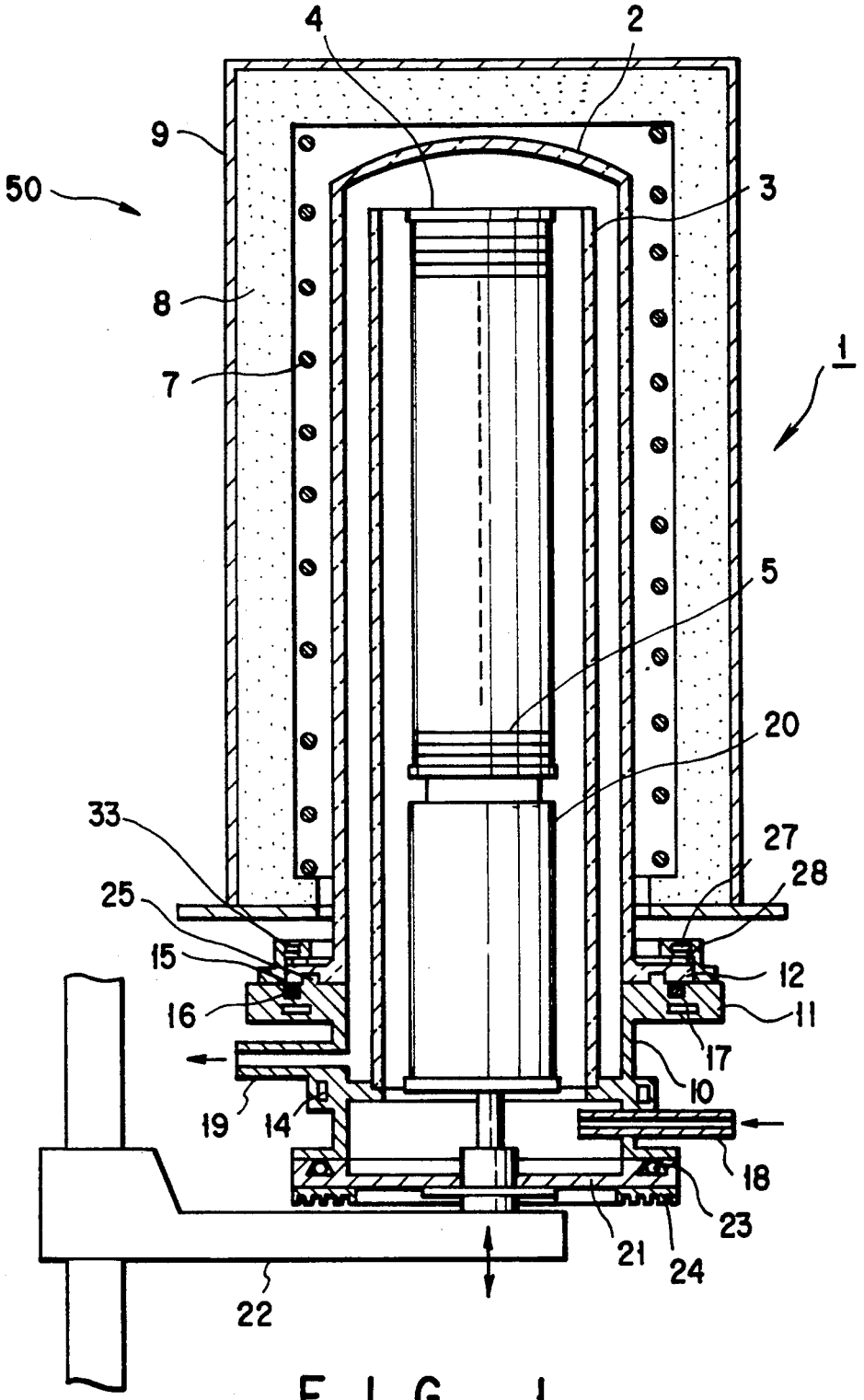
FIG. 1 is a sectional view showing the heat processing apparatus of the vertical type according to a first embodiment of the present invention.
Figure 2:
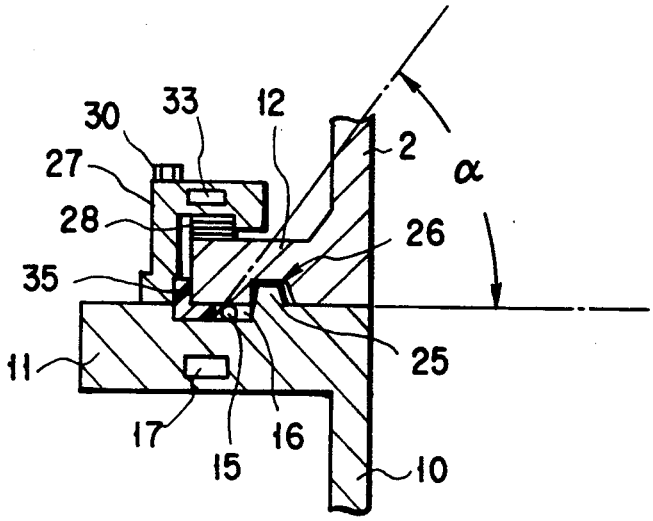
FIG. 2 is a sectional view showing the main portion of the heat processing apparatus in FIG. 1.
Figure 3:
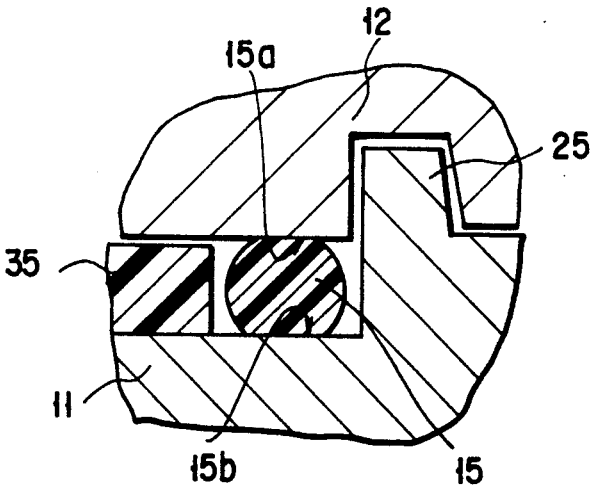
FIG. 3 is a sectional view showing an O-ring attached to the heat processing apparatus in FIG. 1.

FIGS. 1 through 3 show a first embodiment of the present invention. A heat processing apparatus 1 of the vertical type has a process tube 2 which is closed at the top thereof but opened at the bottom thereof. This process tube 2 is a cylinder made of heat resistant material such as quartz. An inner cylinder 3 made of quartz, for example, and opened at the top and bottom thereof erects in the process tube 2, extending eccentric with the tube 2. A wafer boat 4 made of quartz, for example, is housed in the inner cylinder 3. A plurality of matters to be process, or semiconductor wafers 5, for example, are stacked in the wafer boat 4 in the vertical direction and at a certain pitch. These semiconductor wafers 5 can be put in and off the wafer boat 4.

Resistant heaters 7 concentrically encloses the process tube 2. An outer cylindrical shell 9 made of stainless steel, for example, also concentrically encloses the heaters 7 with a heat insulator 8 interposed between them. These process tube 2, heaters 7, heat insulator 8 and outer shell 9 form a heating furnace 50. The temperature in the process tube 2 can be set in a range of 500°-1200° C., while controlling the heaters 7.

A cylindrical manifold 10 made of stainless steel and serving as a seal for the process tube 2 is connected to the lower end of the process tube 2. The manifold 10 has a ring-shaped flange 11 at the top thereof and the process tube 2 has an outward projection 12 at the bottom thereof. The outward projection 12 of the process tube 2 is mounted on the flange 11 of the manifold 10, sandwiching between them a ring-shaped O-ring 15, which is made of elastic material and which serves as a seal member.

The O-ring 15 is made of transparent resin. This is because infrared rays radiated from the heating furnace 50 are allowed to pass through the O-ring 15 not to heat it to high temperature. It is seated in a ring-shaped groove 16 on the top of the flange 11. It contacts both of the top of the flange 11 of the manifold 10 and the underside of the outward projection 12 of the process tube 2 to air-tightly seal the process tube 2. The flange 11 of the manifold 10 has a ring-shaped passage 17 for cooling water under the ring-shaped groove 16.

The manifold 10 supports the inner cylinder 3 at the lower end of the cylinder 3. A pipe 18 through which process gas is supplied into the process tube 2 is connected to on side of the manifold 10 and an exhaust pipe 19 which is connected to a vacuum pump manifold 10. The process tube 2 can be therefore made vacuum by the vacuum pump through the exhaust pipe 19. The manifold 10 has an auxiliary cooling water passage 14 extending round its center portion.

The wafer boat 4 is mounted on a heating sleeve 20 made of quartz, for example. The heating sleeve 20 is freely rotatably supported by a cap 21 made of stainless steel, for example. The cap 21 is held by a lifter system 22 such as the boat elevator to load and unload the wafer boat 4 into and out of the inner cylinder 3. The cap 21 cooperates with an O-ring 23 to air-tightly seal the open bottom of the manifold 10 when the heat process is to be carried out in the process tube 2. Air cooling fins 24 are attached to the underside of the cap 21 along the outer rim of the cap 21 to prevent the O-ring 23 from being heated.

A light radiation shielding section 25 is formed on the top of the manifold 10. This light radiation shielding section 25 is located inside and adjacent to the O-ring 15 and it extends along the groove 16 on the flange 11 of the manifold 10. It is a ring-shaped projection in this case, serving to shield light radiation emitted from the heating furnace 50 to the O-ring 15.

More specifically, this light radiation shielding section 25 is a part of the flange 11 of the manifold 10, projecting upward from the top of the flange 11. It is made of stainless steel, for example, which is same heat resistant material as that of the flange 11. The height of the light radiation shielding section 25 measured from the bottom of the ring-shaped groove 16 is set 20 mm, for example, causing the elevation angle $\alpha$ of the light radiation shielding section 25 to be in a range of 45-60 degrees, as shown in FIG. 2. This elevation angle $\alpha$ is formed between the horizontal line and a line extending from the bottom center of the ring-shaped groove 16 to the heating furnace 50 while contacting the top of the light radiation shielding section 25. On the other hand, a groove 26 is formed on the underside of the ring-shaped outward projection 12 of the process tube 2 and the light radiation shielding section 25 on the flange 11 of the manifold 10 is fitted into the groove 26.

A fixing member 27 is located outside the ring-shaped outward projection 12 of the process tube 2 to press and fix this projection 12 of the process tube 2 to the flange 11 of the manifold 10. The fixing member 27 is a ring made of stainless steel and having a thick and crank-shaped section. It is fixed to the flange 11 by bolts 30.

One of heat transmitting members 28 shown in FIGS. 4A through 4E is sandwiched between the under-side of a horizontal portion of the fixing member 27 and the top of the ring-shaped outward projection 12 of the process tube 2. These heat transmitting members 28 are rings of metal tubes made of excellent heat resistant and conductive elastic matter such as Al, Cu and Ag, or a ring of carbon fibers made of firmly-pressed carbon. They have a thickness of 3-5 mm to closely contact the fixing member 27 and the outward projection 12 of the process tube 2. The heat of the outward projection 12 of the process tube 2 can be radiated toward the fixing member 27 through the heat transmitting member 28. Even when the process tube 2 is exhausted vacuum, the heat transmitting member 28 can create mechanical and thermal close contact between the ring-shaped outward projection 12 and the fixing member 27.

Figure 4A:
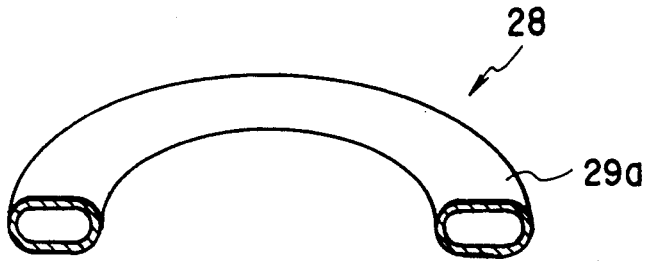
FIGS. 4A through 4E are perspective and sectional views showing heat transmitting members employed by the heat processing apparatus in FIG. 1.
Figure 4B:
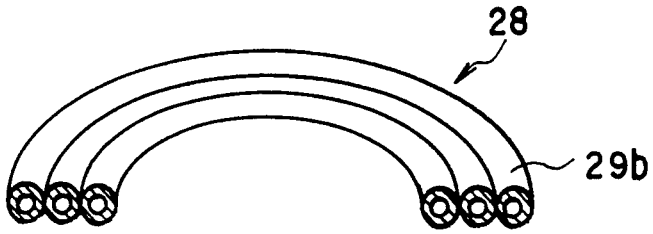
Figure 4C:
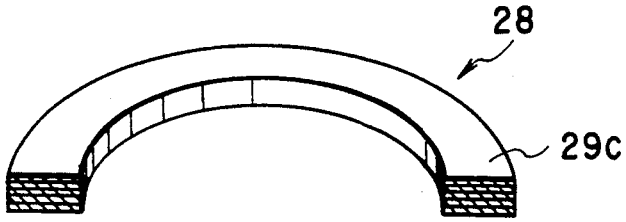
Figure 4D:
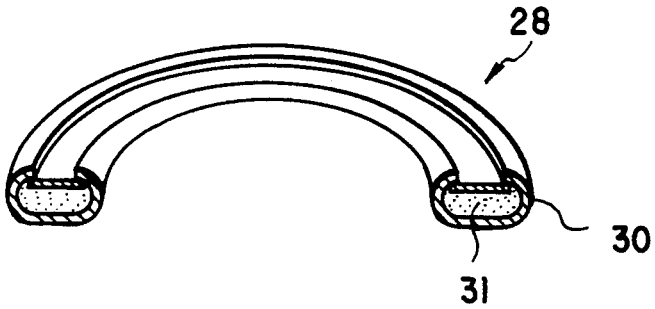
Figure 4E:
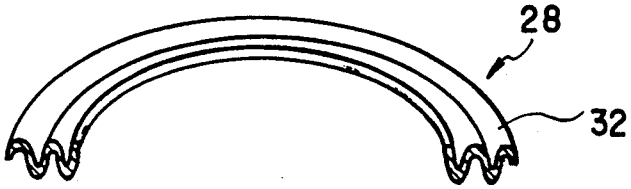

It is the most preferable that the heat transmitting member 28 is a metal tube 29*a* made of Al, Cu or Ag and having an oval section, as shown in FIG. 4A. It may be a ring formed by metal tubes 29b concentric with one another and each having a circular section, as shown in FIG. 4B. A ring 29c formed by carbon fibers, as shown in FIG. 4C, can also be used as the heat transmitting member 28. A ring 30 having an oval section cut away the top thereof may be made of aluminum, elastic and excellent in heat conductivity, and filled with a filler 31 such as ceramic fibers and aluminum powder, as shown in FIG. 4D. A ring-shaped and corrugated packing 32 made of metal such as aluminum, as shown in FIG. 4E, may be used as the heat transmitting member 28.

The thickness of the heat transmitting member 28 is set larger than a clearance formed between the outward projection 12 and the fixing member 27 when the process tube 2 is exhausted vacuum.

The horizontal portion of the fixing member 27 has therein a coolant passage 33, ring-shaped and rectangular in section. Heat transmitted from the ring-shaped outward projection 12 of the process tube 2 through the heat transmitting member 28 can be absorbed and removed by coolant such as water flowing through the coolant passage 33. The coolant passage 33 has an inlet (not shown) through which the coolant is supplied and an outlet (not shown) through which the coolant is discharged. A spacer member 35 made of PTFE (Teflon) and having an L-shaped section is sandwiched between the front lower rim of the ring-shaped outward projection 1 of the process tube 2 and the flange 11 of the manifold 10.

The wafer boat 4 in which a plurality of the semiconductor wafers 5 have been housed is loaded in the process tube 2 by the lifter system 22. The open bottom of the manifold 10 is closed by the cap 21 to air-tightly seal the process tube 2. The process tube 2 is exhausted through the exhaust pipe 19 by the vacuum pump (not shown) to reduce its pressure to a predetermined value of 0.5 Torr, for example. At the same time, a predetermined amount of process gas is supplied into the process tube 2 through the gas pipe 18 while heating the process tube 2 to a predetermined temperature of 800° C., for example, by the heaters 7.

Heat is transmitted by conduction, convection and radiation and it is well-known that heat is transmitted mainly by radiation in common industrial furnaces heated higher than 600° C. The process tube 2, the inner cylinder 3 and the heating sleeve 20 are made of quartz. Therefore, almost all of light (or infrared rays) radiated from the heating furnace 50 including the heaters 7 can pass through them. The infrared rays thus passed are shielded by the light radiation shielding section 25 located inside and adjacent to the O-ring 15 which serves as the seal member.

The temperature of the light radiation shielding section 25 becomes about 300° C. The O-ring 15 is not heated by infrared rays emitted from the heaters 7 but heated by infrared rays radiated from the heated light radiation shielding section 25 and by heat transmitted from the process tube 2. Because the O-ring 15 is made of transparent material, however, it allows light radiated form the light radiation shielding section 25 to pass it. It is therefore heated mainly by the heat transmitted from the process tube 2.

As shown in FIG. 3, the O-ring 15 is contacted, at a top portion 15a thereof, with the underside of the ring-shaped outward projection 12 of the process tube 2. This top portion 15a of the O-ring 15 is therefore liable to become relatively high in temperature. However, the ring-shaped outward projection 12 is cooled through the heat transmitting member 28, which is closely contacted with the projection 12, by the coolant flowing through the coolant passage 33 in the fixing member 27. The top portion 15a of the O-ring 15 can be thus prevented from becoming higher than 200° C. In other words, the O-ring 15 cannot be so heated as to damage its sealing ability. The heat resistant temperature of the O-ring 15 is 200° C. in this case. The flow rate of the coolant flowing through the coolant passage 33 is therefore set 1 liter/min not to make the top portion 15a of the O-ring 15 higher than 200° C.

The flange 11 of the manifold 10 has the cooling water passage 17 therein. When the amount and temperature of the cooling water flowing through the passage 17 are controlled, therefore, temperatures of the flange 11 and the manifold 10 can also be controlled. A bottom portion 15b of the O-ring 15 which is contacted with the top of the flange 11 can be thus kept to be in a range of 50°-100° C.

The temperature of the O-ring 15 can be kept lower than 200° C. in this manner. In addition, the whole of the manifold 10 can be cooled by the cooling water flowing through the passages 17 and 14.

When the temperature of the manifold 10 is kept higher than 120° C., no reaction product, unnecessary and easy to peel off, adheres to the manifold 10. When it is kept lower than 300° C., stainless steel of which the manifold 10 is made is hardly eroded by the process gas ($SiH_2Cl_2$). It is therefore preferable that flow rates and temperatures of the cooling water flowing through the passages 14 and 17 are controlled to keep the temperature of the manifold 10 in a range of 120°-300° C.

The above-described embodiment of the present invention has been a combination of three measures, first of them comprising the light radiation shielding section 25 provided adjacent to the O-ring 15, second of them comprising the O-ring 15 made of elastic transparent material to allow light radiated to pass it, and third of them comprising the heat transmitting member 28 having excellent heat conductivity and the coolant passage 33 for discharging heat transmitted through the heat transmitting member 28 outside the system. However, each of these measures may be used independently of the others, or two of them may be combined.

Tests were conducted in a case where only the third measure was used while heating the furnace to 800° C. by the heaters 7. When the heat transmitting member 28 and the coolant passage 33 were not provided, the top portion 15a of the O-ring 15 was heated to a temperature of 230° C., but when they were employed, it was cooled to a temperature of 170° C.

Figure 5:
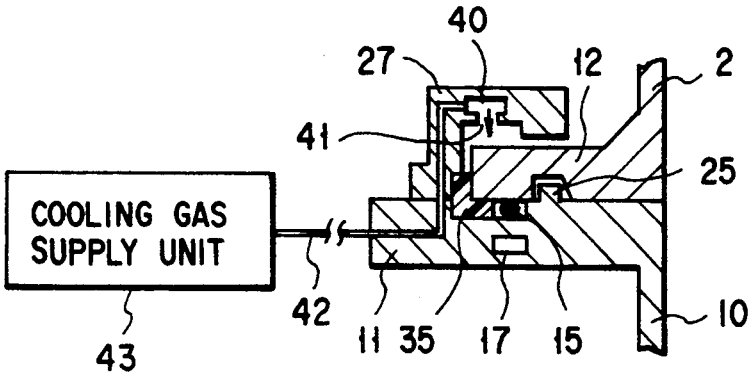
FIG. 5 is a sectional view showing the main portion of the heat processing apparatus of the vertical type according to a second embodiment of the present invention.

A second embodiment of the present invention will be described with reference to FIG. 5. Same components as those in the first embodiment will be denoted by same reference numerals and the second embodiment will be described in detail.

According to the second embodiment of the present invention, a gas passage 40 and a gas jetting outlet 41 are provided instead of the heat transmitting member 28 and the coolant passage 33 in the first embodiment. More specifically, the ring-shaped gas passage 40 through which cooling gas such as $N_2$ gas flows is formed in the fixing member 27. A cooling gas supply unit 43 is connected to the gas passage 40 by a cooling gas pipe 42. The gas passage 40 has the gas jetting outlet 41 facing the top of the lower end or ring-shaped outward projection 12 of the process tube 2. The ring-shaped outward projection 12 can be thus cooled by cooling gas jetted through the gas jetting outlet 41. The gas jetting outlet 41 extends like a ring along the gas passage 40 to jet cooling gas all over the top of the ring-shaped outward projection 12.

The light radiation shielding section 25, the O-ring 15 made of transparent material and the cooling water passage 17 in this example can serve same as in the first embodiment. In addition, cooling gas such as $N_2$ gas is jetted against the top of the ring-shaped outward projection 12 of the process tube 2 through the gas jetting outlet 41. The ring-shaped outward projection 12 can be thus further cooled. The top portion 15*a* of the O-ring 15 which is contacted with the underside of the ring-shaped outward projection 12 (see FIG. 3) can be therefore prevented from becoming high in temperature.

Further, when the flow rate and temperature of the cooling gas are controlled to keep the top portion 15*a* of the O-ring 15 lower than 200° C., the sealing ability of the O-ring 15 can be prevented from becoming deteriorated. The bottom portion 15*b* of the O-ring 15 can be kept in a range of 50°–100° C. by the cooling water flowing through the passage 17, as described above.

This second embodiment of the present invention has been a combination of three measures, first comprising the light radiation shielding section 25, second comprising the O-ring 15 made of elastic transparent material, and third comprising jetting the cooling gas. However, only the third measure comprising jetting the cooling gas may be used, or this third measure may be combined with one of the other two.

Tests were conducted in a case where only the third measure was used while heating the furnace to 800° C. by the heaters 7 When no cooling gas was jetted against the top of the ring-shaped outward projection 12, the top portion 15*a* of the O-ring 15 was heated to 230° C., but when the cooling gas was jetted at a flow rate of 50–80 liters/min, it was cooled to 200° C.

Figure 6:
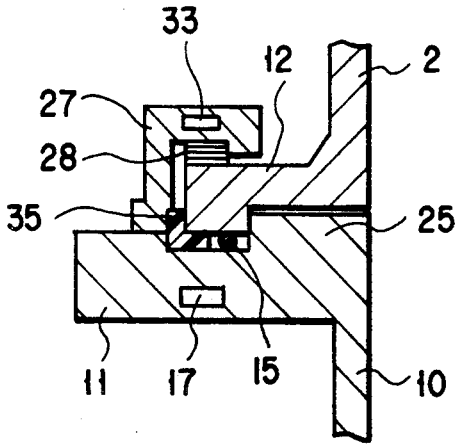
FIG. 6 is a sectional view showing another variation of the light radiation shielding section.

Although the light radiation shielding section 25 has been a narrow projection projected upward from the top of the flange 11 of the manifold 10 in the first and second embodiments, it may be arranged that the inner rim portion of the groove 16 is made higher than the outer rim portion thereof, as shown in FIG. 6, to serve as the light radiation shielding section 25.

Although the heating furnace has used the inner cylinder 3 to have double-cylinder structure, it may be of single- or triple-cylinder structure.

The present invention can also be applied to the heat processing apparatus of the horizontal type, the diffusion apparatus and other heat processing apparatuses used in the course of manufacturing semiconductors and LCVs.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A heat processing apparatus comprising:

a heating furnace;

a process tube located in the heating furnace and having an open bottom;

a manifold connected to the open bottom of the process tube;

a sealing member sandwiched between the process tube and the manifold to air-tightly seal the process tube;

fixing means for fixing the process tube to the manifold;

heat transmitting means made of metal and sandwiched between the fixing means and the process tube to radiate heat at that area of the process tube, which is opposed to the fixing means, to the fixing means by heat conduction; and heat exchange means arranged in the fixing means and having a passage through which heat exchanging medium flows to cool the fixing means by heat exchange.

2. The heat processing apparatus according to claim 1, wherein said heat transmitting means is made of Al, Cu or Ag.

3. The heat processing apparatus according to claim 1, wherein said heat transmitting means is made by a hollow tube.

4. The heat processing apparatus according to claim 3, wherein said heat transmitting means is made by a hollow tube filled with Al powder or ceramic wool.

5. The heat processing apparatus according to claim 3, wherein said heat transmitting means is a ring-shaped aluminum tube having an oval section.

6. The heat processing apparatus according to claim 3, wherein said heat transmitting means is made by plural ring-shaped tubes arranged concentric with one another.

7. The heat processing apparatus according to claim 1, wherein said heat transmitting means is made by plural ring-shaped and laminated plates.

8. The heat processing apparatus according to claim 1, wherein said heat transmitting means is a ring-shaped and corrugated plate.

9. The heat processing apparatus according to claim 1, wherein said manifold has a cooling means provided with a passage through which cooling medium flows.

10. The heat processing apparatus according to claim 1, further comprising a light radiation shielding means located inside and adjacent to the sealing member and projected upward from the top of the manifold to shield light radiated from the heating furnace to the sealing member.

11. The heat processing apparatus according to claim 10, wherein said sealing member is seated in a groove on the top of the manifold and said light radiation shielding means is formed inside the groove.

12. The heat processing apparatus according to claim 1, further comprising a gas passage formed in the fixing means to allow gas to flow through it and a gas jetting outlet communicated with the gas passage to jet gas against that area of the process tube which is opposed to the fixing means.

13. A heat processing apparatus comprising:

a heating furnace;

a process tube located in the heating furnace and having an open bottom;

a manifold connected to the open bottom of the process tube;

a sealing member sandwiched between the process tube and the manifold to air-tightly seal the process tube;

fixing means for fixing the process tube to the manifold; and light radiation shielding means located inside and adjacent to the sealing member and projected upward from the top of the manifold to shield light radiated from the heating furnace to the sealing member.

14. The heat processing apparatus according to claim 13, wherein said sealing member is seated in a groove on the top of the manifold and said light radiation shielding means is formed inside the groove.

15. A heat processing apparatus comprising:

a heating furnace;

a process tube located in the heating furnace and having an open bottom;

a manifold connected to the open bottom of the process tube;

a sealing member sandwiched between the process tube and the manifold to air-tightly seal the process tube;

fixing means for fixing the process tube to the manifold;

a gas passage formed in the fixing means to allow gas to pass through it; and a gas jetting outlet communicated with the gas passage to jet gas against that area of the process tube which is opposed to the fixing means.

* * * * *